US005704298A

United States Patent [19]

Corpuz, Jr. et al.

[11] Patent Number: 5,704,298

[45] Date of Patent: Jan. 6, 1998

[54] COMPUTER WORKSTATION

[75] Inventors: Roque Matias Corpuz, Jr., Grand Rapids; Brian D. T. Alexander, Fennville, both of Mich.

[73] Assignee: Haworth, Inc., Holland, Mich.

[21] Appl. No.: 649,031

[22] Filed: May 16, 1996

Related U.S. Application Data

[63] Continuation-in-part of Ser. No. 52,783, Apr. 5, 1996.

[51] Int. Cl.[6] ..... A47B 35/00

[52] U.S. Cl. ..... 108/50; 108/64

[58] Field of Search ..... 108/50, 59, 64, 108/90, 95; 312/233.3, 233.2, 223.1, 194, 195; 248/917, 918

[56] References Cited

U.S. PATENT DOCUMENTS

| | | | |
|---|---|---|---|
| 493,605 | 3/1893 | Tiffany . | |
| 1,889,783 | 12/1932 | Harman | 108/95 |
| 2,605,155 | 7/1952 | Lewis . | |
| 2,625,986 | 1/1953 | Siff . | |
| 3,212,748 | 10/1965 | Faurot | 108/95 X |
| 3,550,892 | 12/1970 | Propst . | |
| 3,879,084 | 4/1975 | Jones . | |
| 3,920,276 | 11/1975 | Sparrow . | |
| 4,365,561 | 12/1982 | Tellier et al. | 108/64 X |
| 4,672,898 | 6/1987 | Davidson . | |
| 4,852,500 | 8/1989 | Ryburg et al. | 108/50 X |
| 4,879,955 | 11/1989 | Moll et al. . | |
| 4,986,194 | 1/1991 | Bollman . | |
| 5,078,055 | 1/1992 | Bellini et al. | 108/64 |
| 5,330,147 | 7/1994 | Volcheff et al. | 248/917 X |
| 5,522,323 | 6/1996 | Richard | 108/10 |

FOREIGN PATENT DOCUMENTS

| | | | |
|---|---|---|---|
| 992281 | 7/1964 | Denmark | 108/50 |
| 4112180 | 10/1992 | Germany | 312/223.3 |

OTHER PUBLICATIONS

*Interiors*, "Products Introduction", May 1995 (2 pages).

*Today's Facility Manager*, "Product of the Month", May 1995 (1 page).

*Primary Examiner*—Jose V. Chen

*Attorney, Agent, or Firm*—Flynn, Thiel, Boutell & Tanis, P.C.

[57] ABSTRACT

A computer workstation comprising a keyboard support stand and a monitor support stand mounted to a support leg of said keyboard support stand so as to be swingable about a vertical axis of the support leg. The monitor support stand includes a base, a cross member extending between the support leg and the base, and a support column which extends upwardly from the base and vertically supports a monitor support tray. The monitor support tray is both rotatable and height-adjustable relative to the base, and the base is swingable about the support leg to permit ready repositioning of the monitor relative to a user.

19 Claims, 8 Drawing Sheets

COMPUTER WORKSTATION

CROSS-REFERENCE TO RELATED APPLICATION

This is a continuation-in-part of U.S. Design patent application Ser. No. 29/052,783, filed Apr. 5, 1996, the disclosure of which is incorporated herein by reference in its entirety.

FIELD OF THE INVENTION

This invention relates to a computer workstation and more particularly to a stand or table for supporting a keyboard provided in combination with a stand for supporting a computer monitor or the like.

BACKGROUND OF THE INVENTION

Computers as used extensively in offices and businesses conventionally include a monitor (commonly referred to as a CRT), a keyboard and a central processing unit (commonly referred to as a CPU). Computers are readily accommodated in workstation areas typically formed by systems furniture and, in particular, by wall panels that define distinct workstation areas. A need exists, however, for computer workstations which are readily transportable and are readily adjustable to accommodate the unique needs and characteristics of a user.

An example of a movable computer support stand is disclosed in U.S. Pat. No. 5,322,025. This patent discloses a conventional arrangement of a stand which includes one worksurface for supporting a keyboard and an additional worksurface for supporting the CPU and monitor. This computer support stand comprises a single integrated structure. Such arrangement, however, does not provide for ready adjustment of the monitor's position relative to the keyboard support as well as the position in which the user normally will sit.

It is an object of this invention, therefore, to provide a computer workstation which is readily movable for repositioning of the workstation area and is also readily adjustable to accommodate the unique characteristics of a user. It is a further object to provide ready adjustability of the relative position of the monitor with respect to the user and the keyboard and, more particularly, to provide a monitor support stand which itself is readily height-adjustable and movable in the workstation area independently of a keyboard support stand carrying the keyboard supporting worksurface. It is further desirable that the monitor support stand be removable from the keyboard support stand so as to permit repositioning of the monitor support stand on the structural framework of the computer workstation.

This invention includes a primary worksurface area which supports the keyboard. The primary worksurface area preferably is adjustable so as to adjust the angular orientation of the keyboard relative to the user to optimize comfort during use. Such angular adjustment can be accomplished in one embodiment by providing a keyboard support tray which is angularly adjustable relative to the structural framework of the stand while at the same time permitting similar angular adjustment of an arm rest disposed in front of the keyboard support tray. This arrangement may also be height-adjustable to provide further flexibility in optimizing comfort. In another embodiment, the primary worksurface area may be defined by a single horizontally enlarged table top, the angular orientation and height of which is adjustable relative to the structural framework which supports the table top.

In both of the above embodiments, the structural framework includes vertically extending uprights or support legs which provide a plurality of mounting locations for a monitor support stand. The monitor support stand connects to one of the uprights so as to be swingable about the upright. The monitor support stand itself includes a support column having a horizontally enlarged monitor tray which supports a monitor thereon such that the support column is swingable about the connection to the upright to provide for ready repositioning of the monitor. Additionally, the monitor support tray is vertically adjustable and rotatable relative to the support column so as to provide additional degrees of adjustment for the monitor. The monitor support stand may be repositioned and mounted to alternative uprights so as to reposition the monitor support stand on the structural framework.

Other objects and purposes of the invention will be apparent to persons familiar with structures of this general type upon reading the following specification and inspecting the accompanying drawings.

Figure 1:
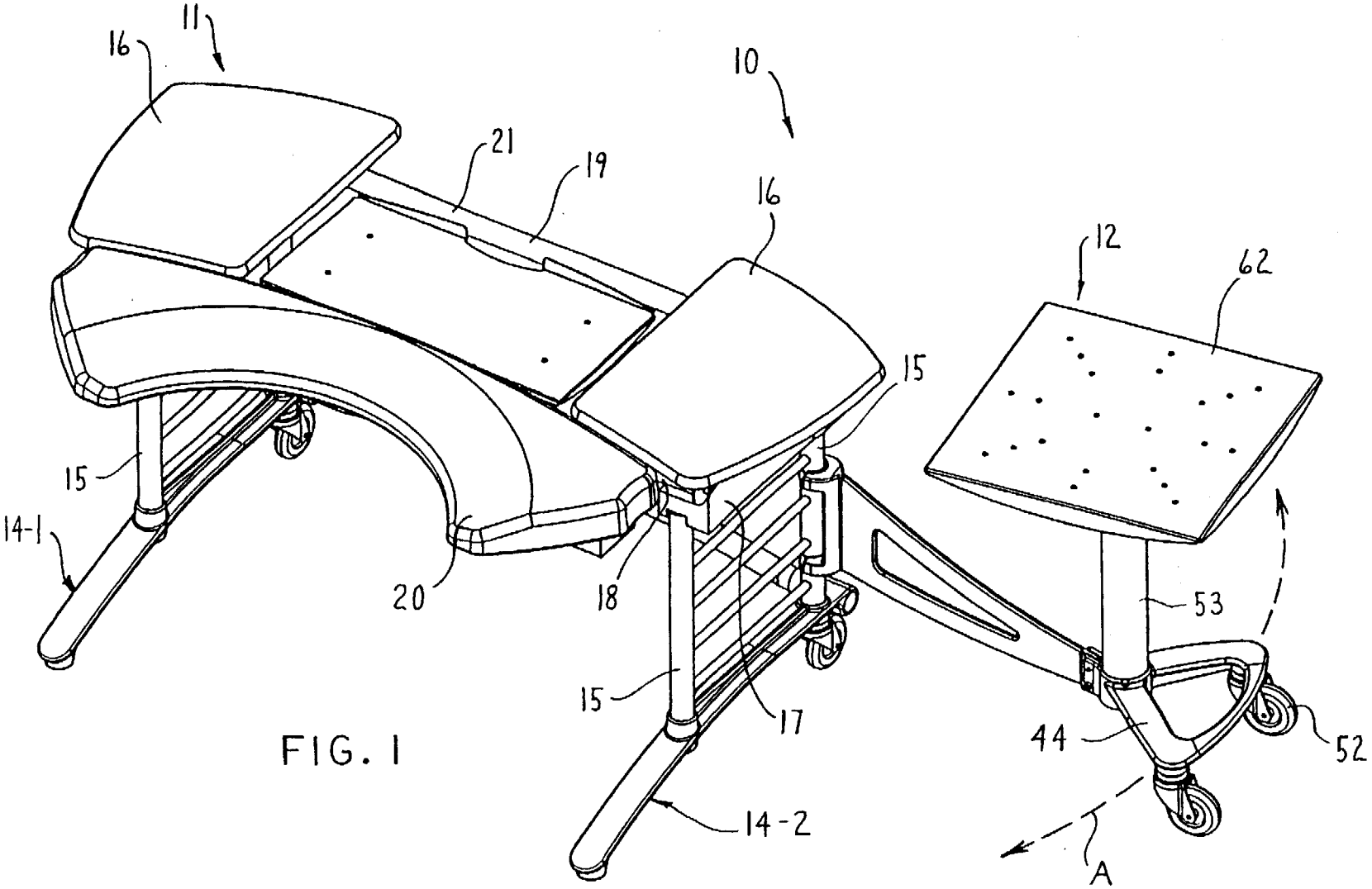
FIG. 1 is a perspective view of a computer workstation including a monitor support stand in combination with a keyboard support stand.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 8:
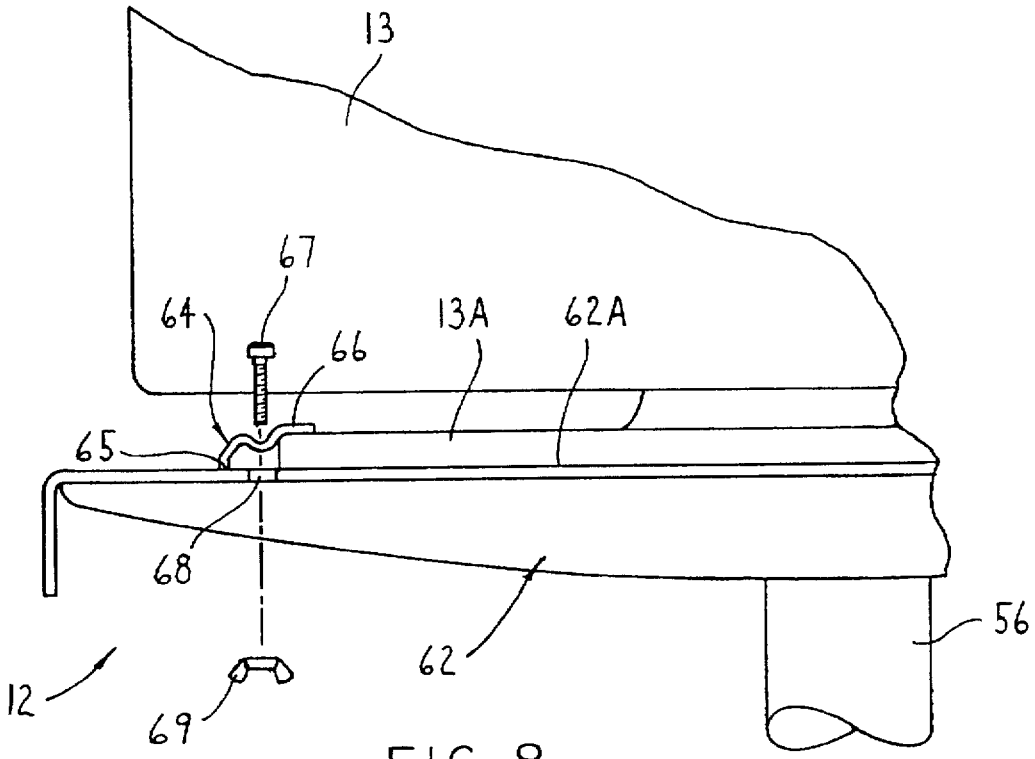
FIG. 8 is a partial front end elevational view illustrating a monitor positioned for mounting on the monitor support stand.

Referring to FIG. 1, the invention relates to a computer workstation 10 comprising a freestanding keyboard support stand 11 and an upright monitor support stand 12 for supporting a computer and, in particular, at least a keyboard (not illustrated) and a monitor 13 (FIG. 8).

The keyboard support stand 11 in the FIG. 1 embodiment includes left and right height-adjustable leg assemblies 14-1 and 14-2 which vertically support left and right side worksurfaces 16 that are fixed to the respective left and right leg assemblies 14-1 and 14-2. The left and right leg assemblies 14-1 and 14-2 each include vertically elongate legs or uprights 15 which support the stand 11 on a support surface, specifically a floor. Preferably the legs 15 have a cylindrical cross-sectional shape and are disposed proximate the four corners of the keyboard support stand 11. Each left and right pair of legs 15 include vertically spaced cross members connected therebetween.

The height of the side worksurfaces 16 is adjustable by height-adjustment means 17. The side worksurfaces 16 are disposed in a laterally spaced relation and connected to the left and right leg assemblies 14-1 and 14-2 by front and rear laterally extending support tubes 18 and 19. The keyboard support stand 11 further includes an arm rest 20 which is selectively pivotable about the front support tube 18 so as to adjust the angular orientation of the arm rest 20. The keyboard support stand 11 also includes a keyboard support tray 21 which is adapted to receive a keyboard (not illustrated) thereon and is similarly angularly adjustable about the front support tube 18 so as to permit selective adjustment of the angular orientation thereof.

The structure and arrangement of the keyboard support stand 11 as illustrated in FIG. 1 is described in copending U.S. patent application Ser. No. 08/649,032, titled KEYBOARD SUPPORT, as filed concurrently herewith, Attorney Reference: Haworth Case 190, and the disclosure thereof is incorporated herein by reference.

Figure 2:
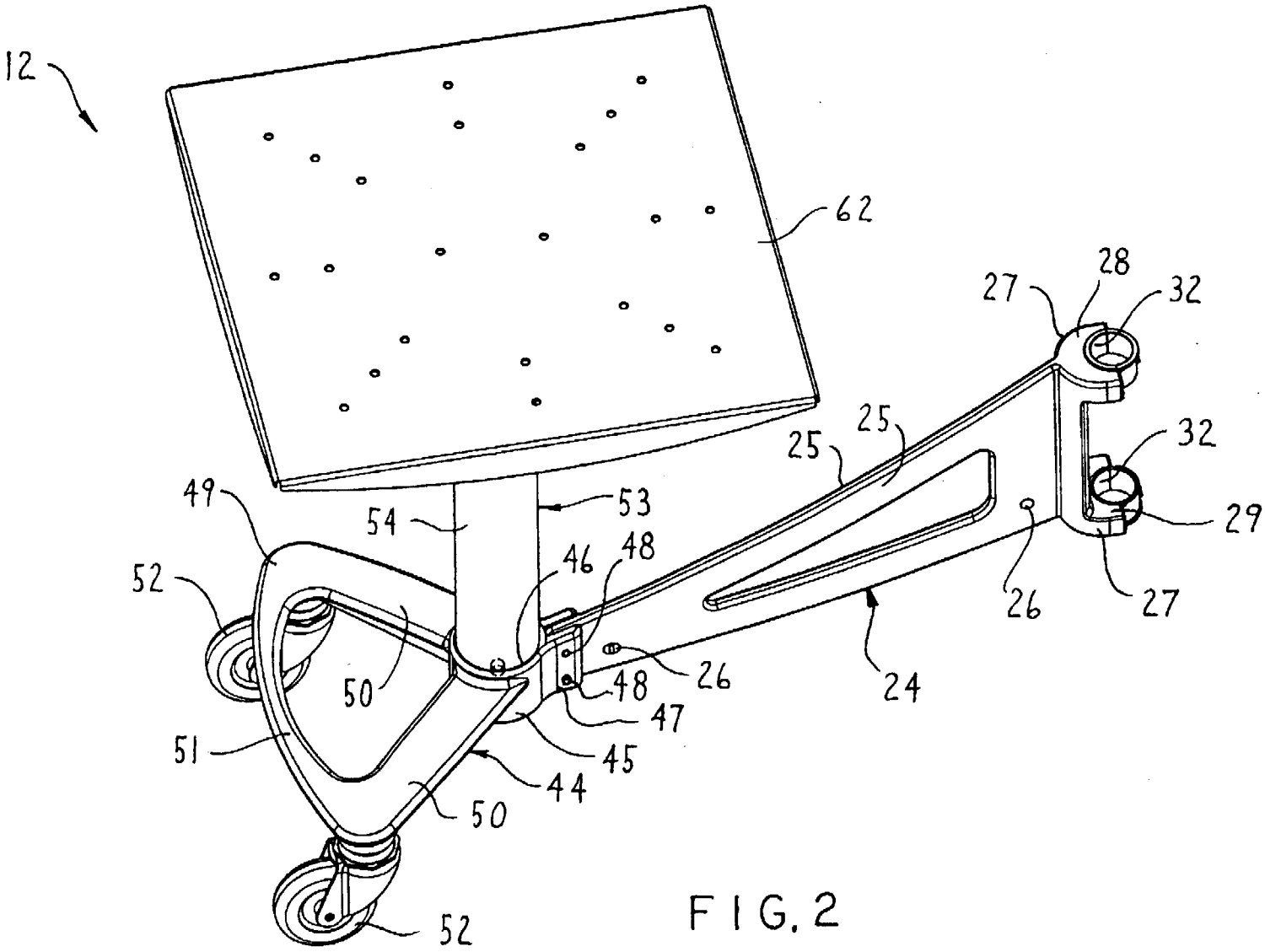
FIG. 2 is a perspective view of a monitor support stand from one side thereof.
Figure 3:
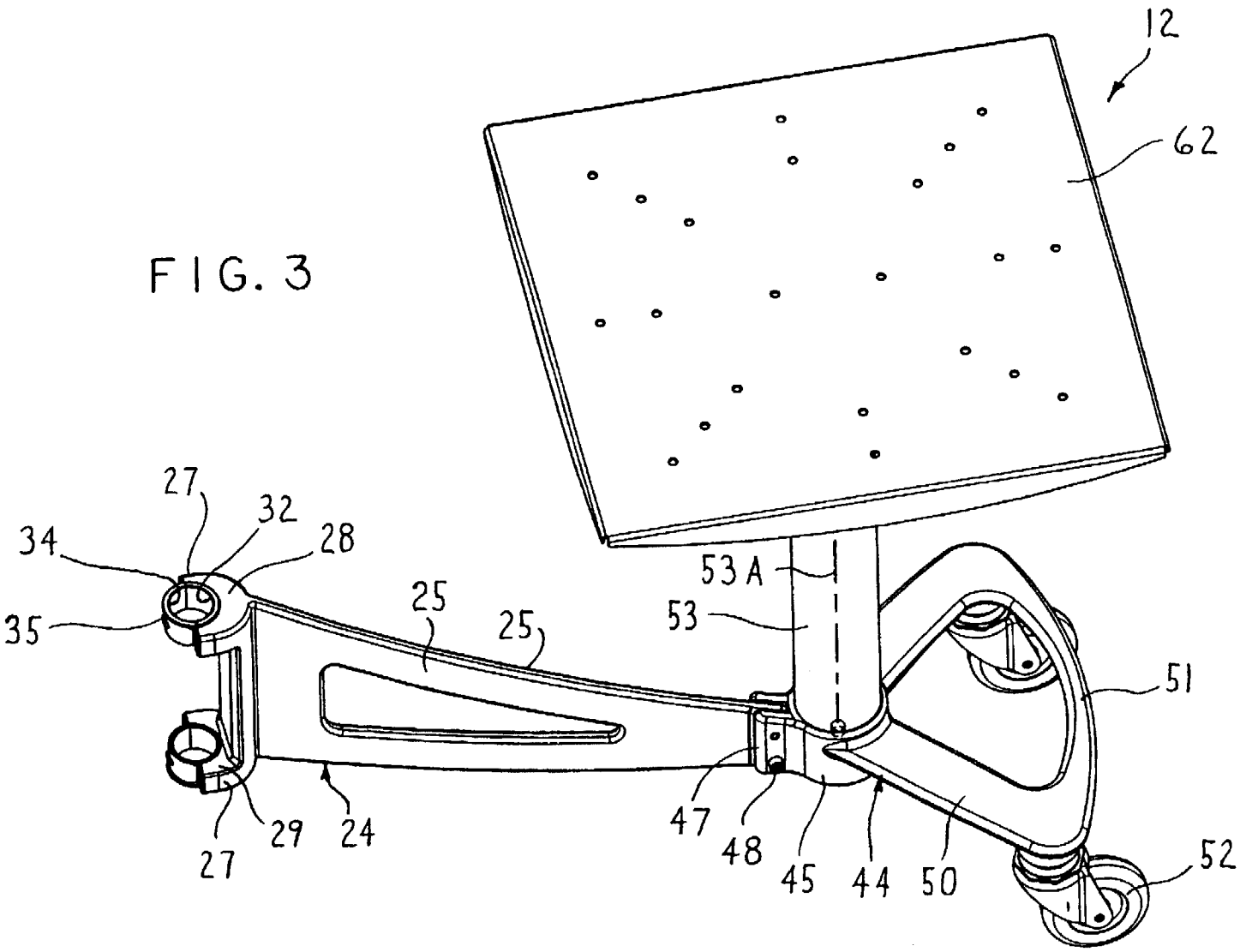
FIG. 3 is a perspective view of the monitor support stand from an opposite side thereof.
Figure 7:
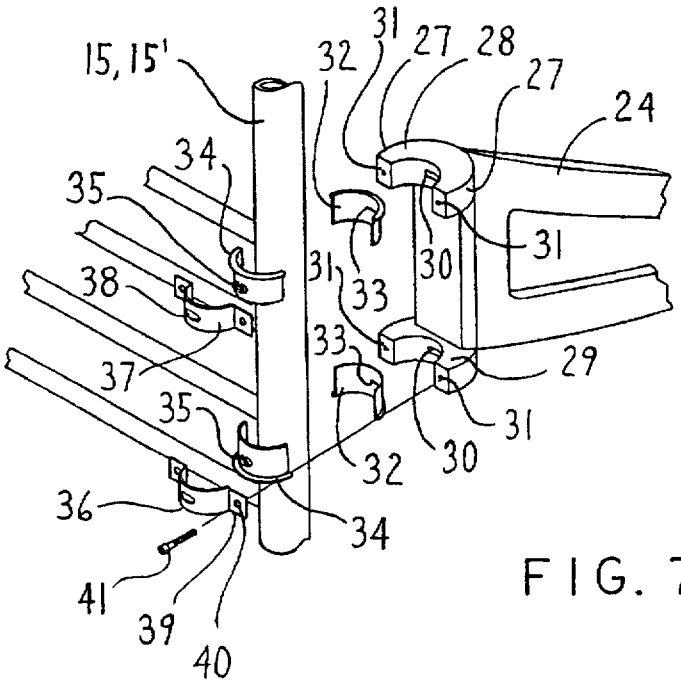
FIG. 7 is a partial exploded view of the connection between the monitor support stand and a leg of the keyboard support stand.

Referring now to FIGS. 2 and 3, the monitor support stand 12 includes a horizontally elongate arm or cross member 24 which is formed of two substantially planar metal plates 25 secured in facing contact by fasteners 26. To effect connection of the monitor support stand 12 to one of the uprights 15 of the keyboard support stand 11, the proximal end of cross member 24 includes a connecting hinge structure which includes a semi-cylindrical portion 27 having a radius of curvature defined about a substantially vertical axis. Referring to FIGS. 2 and 7, the upper and lower regions of the semi-cylindrical portion 27 define upper and lower bearing seats 28 and 29 which open outwardly in a direction oriented generally along the longitudinal axis of the cross member 24. Each bearing seat 28 and 29 includes a notch or recess 30 as well as threaded bores 31 formed in the outward facing end surfaces thereof.

The upper and lower bearing seats 28 and 29 each are adapted to receive a respective inner bearing half 32 that has a half-circular shape and includes a radially projecting pin or projection 33. Each inner bearing half 32 seats within one of the respective upper and lower bearing seats 28 and 29 with the pin 33 of the inner bearing half 32 seating within the notch 30 of the bearing seat 28 or 29 so as to align and prevent rotation of the inner bearing half 32 relative to the respective bearing seat 28 or 29. Similar to the upper and lower bearing seats 28 and 29, each inner bearing half 32 opens outwardly in the direction of the longitudinal axis of the cross member 24 so as to receive one of the uprights 15 therein.

To secure the monitor support stand 12 onto the keyboard support stand 11, an outer bearing half 34, which is formed substantially the same as the inner bearing half 32, is placed over the upright 15 on the side opposite the inner bearing half 32. The outer bearing half 34 similarly is formed with a radially projecting pin or projection 35.

To rotatably secure the upright 15 between the inner bearing half 32 and the respective outer bearing half 34, a mounting bracket 36 is secured to each of the upper and lower bearing seats 28 and 29. More particularly, the mounting bracket 36 includes a semi-cylindrical center portion 37 which fits over the exterior surface of the respective outer bearing half 34. The center portion 37 includes a notch 38 formed therethrough which is adapted to receive the pin 35 of the outer bearing half 34 so as to align and prevent relative rotation of the outer bearing half 34 with respect to the mounting bracket 36. The semi-cylindrical center portion 37 includes flanges 39 having an aperture 40 formed therethrough, which flanges 39 are formed on the opposite sides of the mounting bracket 36.

One of the mounting brackets 36 is secured to each of the upper and lower bearing seats 28 and 29 by threaded fasteners 41 (one of which is illustrated in FIG. 7), which fasteners 41 extend through the aperture 40 of the flange 39 and threadingly engage the corresponding threaded bores 31 of the respective upper and lower bearing seats 28 and 29. When the fasteners 41 are fully tightened, the mounting brackets 36 secure the inner bearing halves 32 and the outer bearing halves 34 in an opposing relation so as to define a circular opening therebetween in which the upright 15 of the keyboard support stand 11 is rotatably engaged. The inner and outer bearing halves 32 and 34 permit reversible swinging of the cross member 24 about the upright 15 so that the monitor support stand 12 moves along the circular path identified by reference arrow A (FIG. 1).

The monitor support stand 12 is movably supported on a base surface, such as a floor or the like, by a base assembly 44 which includes a generally triangular base member having a connector collar 45 defining a hollow cylindrical seat 46 and includes a pair of opposing radially extending connector flanges 47. The connector flanges 47 receive the distal end of the cross member 24 therebetween, which connector flanges 47 and cross member 24 are rigidly connected together by fasteners 48 such as screws or the like which extend therethrough.

The base member also includes two support legs 50 which are fixed to and extend radially away from the connector collar 45 in generally transverse relation and are joined at their distal ends by an arcuate cross piece 51. A pair of caster assemblies 52 extend downwardly from a bottom surface of the base 44 and, in the preferred arrangement, are disposed at the outer ends of the legs 50.

The base assembly of the monitor support stand also includes a cylindrical support column 53 extending upwardly a predetermined distance above the base assembly 44. More particularly, the support column 53 comprises an outer tubular member 54 which has a lower end which seats within the seat 46 of the connector collar 45 and is securely fastened in place by a fastener 55 (FIG. 4) which is threaded upwardly through a bottom wall of the connector collar 45. The outer tubular member 54 defines therein a hollow interior which opens upwardly through the upper end of the tubular member 54.

Figure 4:
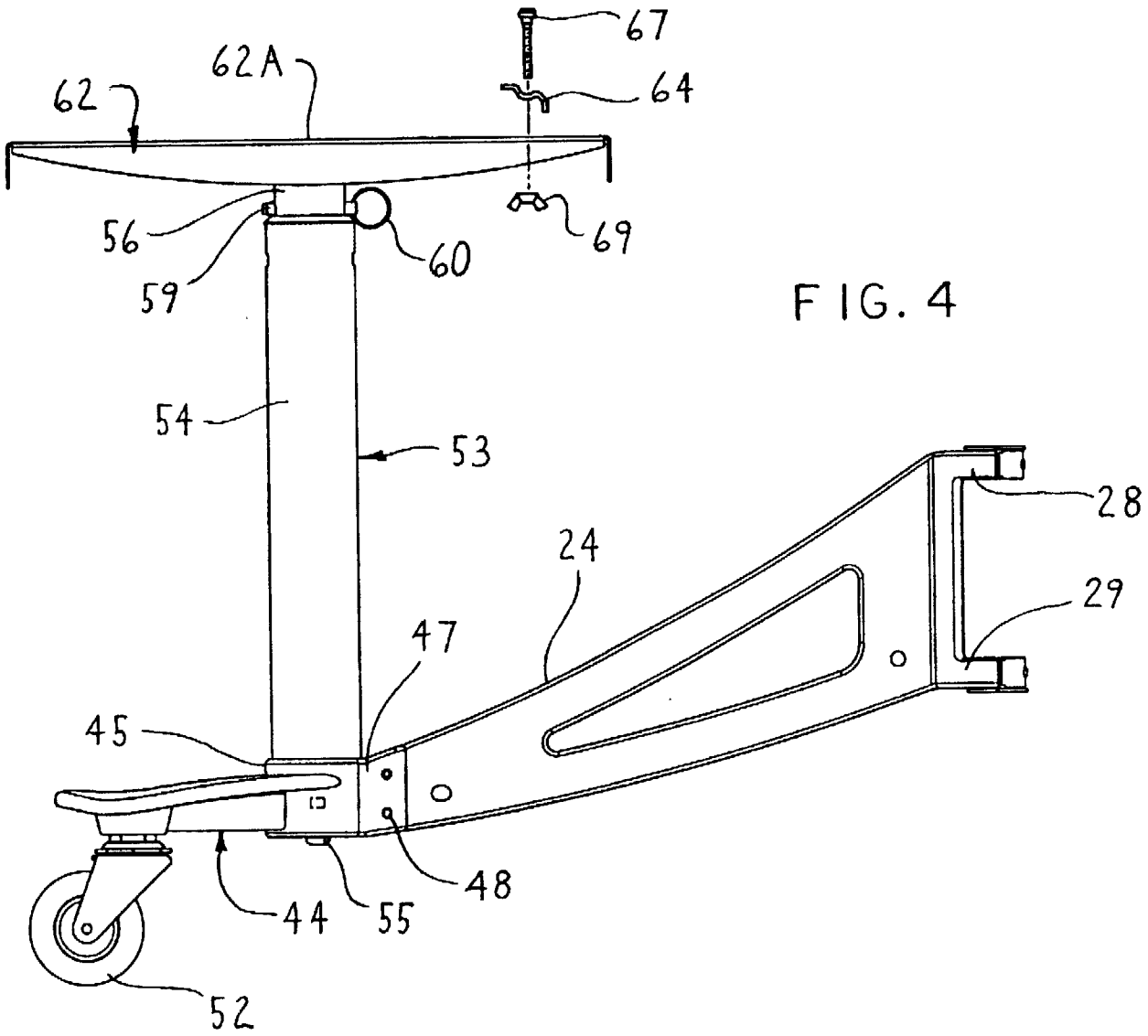
FIG. 4 is a side elevational view of the monitor support stand.
Figure 5:
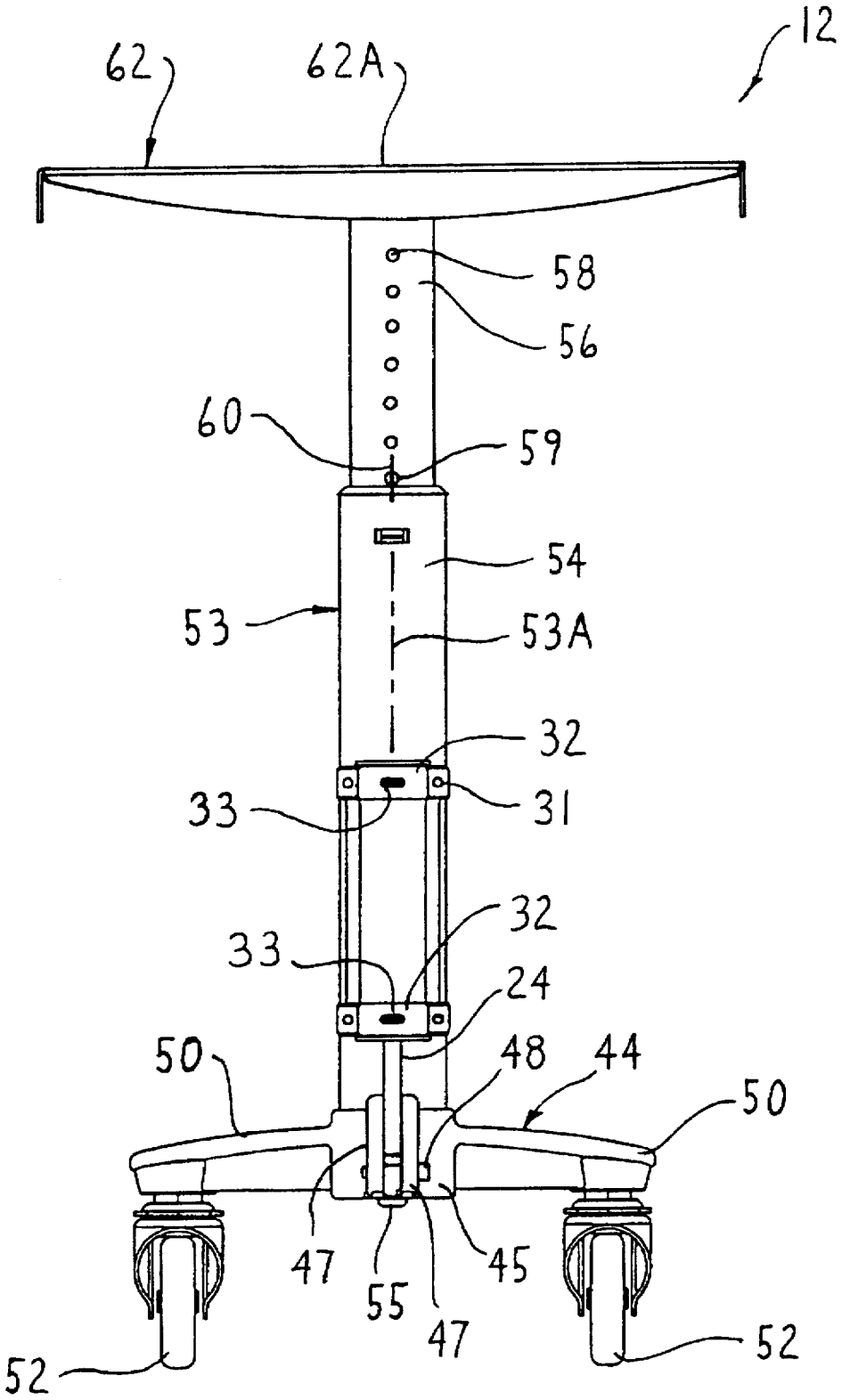
FIG. 5 is an end elevational view of the monitor support stand.

To permit adjustment of the height of a monitor, the support column 53 further includes an inner tubular member 56 which is telescopingly received within the hollow interior of the outer tubular member 54 so that the inner tubular member 56 is vertically movable between a lowered position (FIG. 4) and a raised position (FIG. 5). To effect locking of the inner tubular member 56 at a predetermined vertical height relative to the outer tubular member 54 and more particularly, with respect to the base assembly 44, the inner tubular member 56 includes a plurality of vertically spaced but horizontally aligned apertures 58 formed on opposite sides thereof.

To provide a stop for limiting downward vertical movement of the inner tubular member 56 relative to the outer tubular member 54, an elongate rod-like pin 59 is provided which is dimensioned to be slidably inserted through any horizontally aligned pair of the apertures 58. Referring to FIGS. 4 and 5, the pin 59 includes a pull ring 60 on one end thereof which not only facilitates grasping of the pin 59 but limits the extent of insertion of the pin 59 into the selected pair of apertures 58. Insertion of the pin into the apertures 58 results in the pin 59 abutting against an upper edge of the outer tubular member so as to prevent further downward vertical or sliding movement of the inner tubular member 56 within the hollow interior of the outer tubular member 54.

Figure 6:
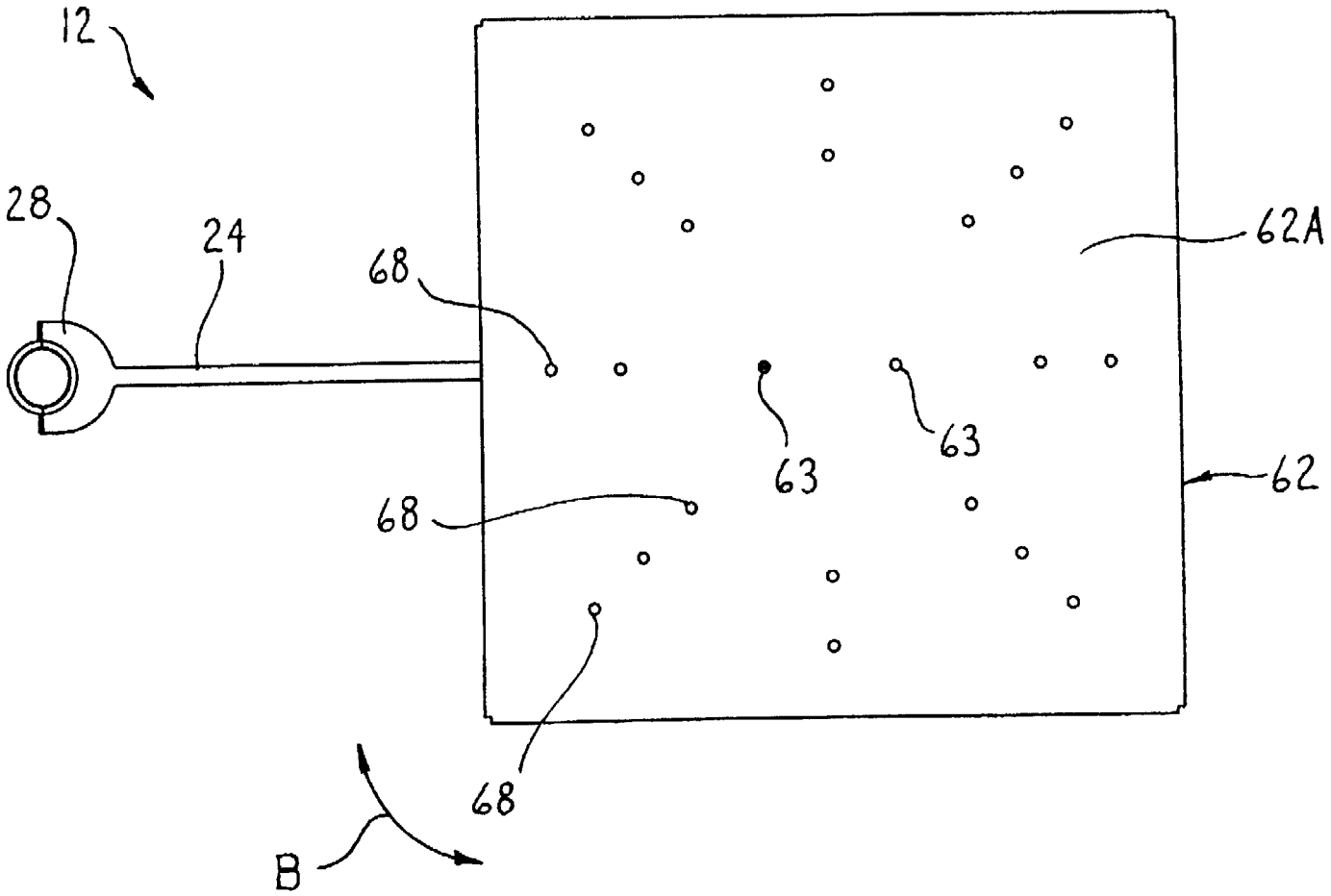
FIG. 6 is a top plan view thereof.

To vertically support a monitor, a monitor support tray 62 is fixedly mounted to an upper end of the inner tubular member 56 by threaded fasteners 63 (FIG. 6) so as to define a horizontally enlarged upward facing surface 62A thereof which supports the monitor. Referring to FIGS. 4, 6 and 8, the monitor support tray 62 has a substantially rectangular shape when viewed from above and is oriented so as to be substantially horizontal when the monitor support stand 12 is attached to the keyboard support stand 11. To prevent dislodgement of the monitor from the keyboard support tray 62 during swinging movement of the keyboard support stand 12 about the upright or support leg 15, or during vertical adjustment of the inner tubular member 56 within the outer tubular member 54, or during angular rotation of the monitor support tray 62 about the vertical central axis 53A of the column 53, mounting means are provided for fixedly securing the monitor in place. These mounting means include a plurality of mounting clips 64 (one of which is illustrated in FIGS. 3 and 8), each of which is formed with a downward extending leg 65 for contact with the upper planar surface of the monitor support tray 62 and a horizontally extending leg 66 which is adapted to contact an upward facing surface of the monitor base 13A so as to clamp the monitor between the horizontal leg 66 and the upper surface 62A of the monitor support tray 62 as generally illustrated in FIG. 8. Clamping of the mounting clip 64 is effected by way of a fastener 67 which extends through an aperture formed through the center portion of the mounting clip 64 and a corresponding aperture 68 (FIG. 6) formed in the monitor support tray 62. A conventional wing nut or other threaded nut 69 is then threadingly engaged with the fastener 67 so as to tighten the clip 64.

As illustrated in FIG. 6, a plurality of apertures 68 are formed vertically through the monitor support tray 62 so as to provide a plurality of mounting locations for the mounting clips 64 and thereby facilitate mounting of a wide variety of monitors. More particularly, the apertures 68 are provided in a predetermined pattern in the monitor support tray 62 and generally include rows of apertures 68 which extend both diagonally and perpendicularly across the monitor support tray 62.

Figure 9:
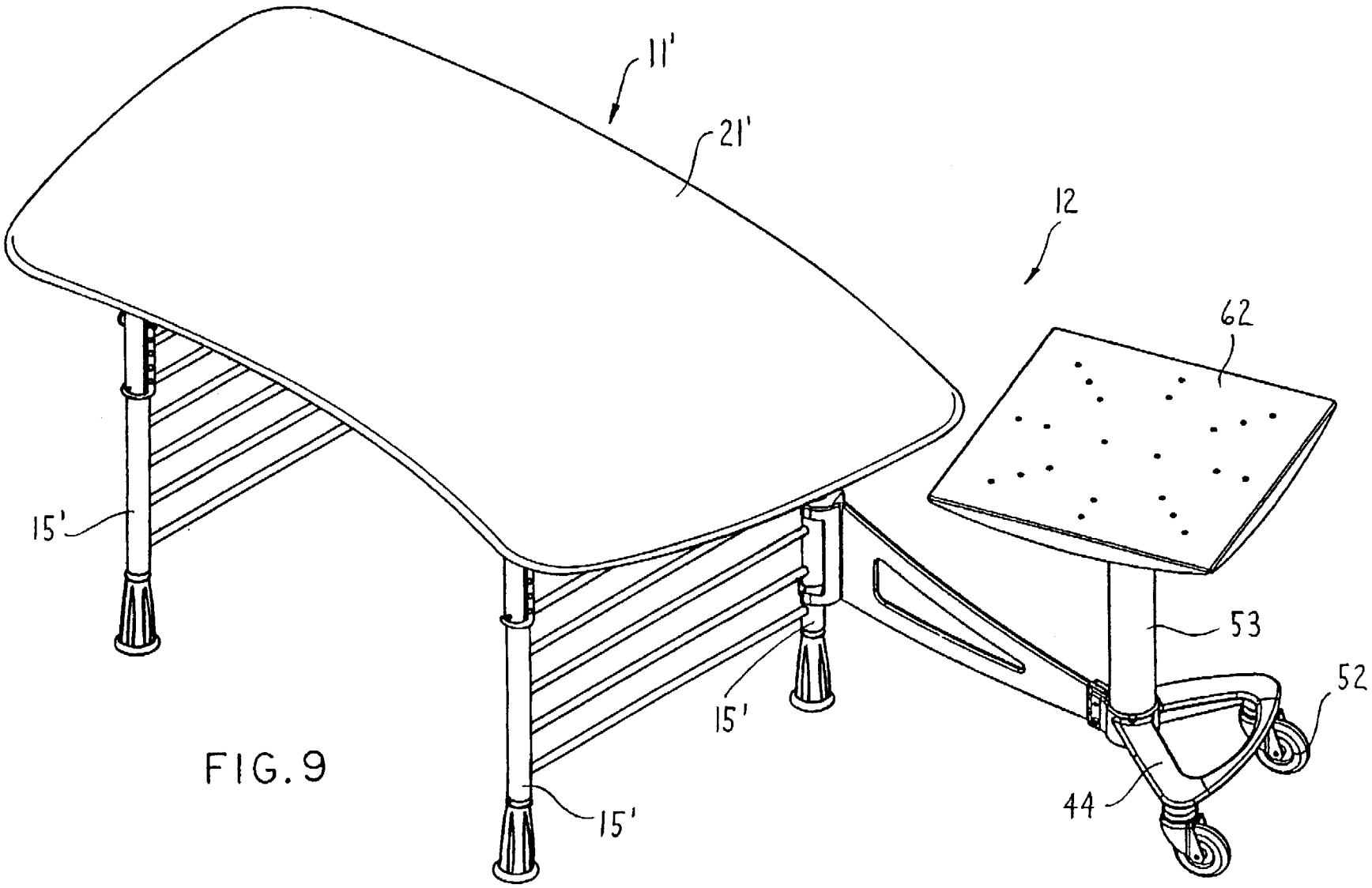
FIG. 9 is a front perspective view illustrating another embodiment of a computer workstation wherein the monitor support stand is attached to a height-adjustable table.

Referring to FIG. 9, an alternative embodiment of the keyboard support stand 11 is illustrated. Common components of the keyboard support stand 11' are identified with the same reference numerals used in FIG. 1 but with the addition of a prime (') thereto. A more complete disclosure of the specific structure of the keyboard support stand 11' illustrated in FIG. 9 is included in copending U.S. patent application Ser. No. 08/459 329, entitled HEIGHT-ADJUSTABLE TABLE, and filed Jun. 2, 1995, the disclosure of which in its entirety is incorporated herein by reference.

More particularly, the keyboard support stand 11' includes a height-adjustable supporting top or worksurface 21'. The support stand 11' further includes support legs 15' to which the monitor support stand 12 is connected. The keyboard support stand 12 is movable both about the support leg 15' and by way of adjustment of the monitor support tray 62 substantially the same as that disclosed herein with respect to FIGS. 1–7.

In operation, the keyboard support stand 12 is connected to a support leg of a keyboard support or table, such as a leg 15 or 15', the selection of which will depend upon the particular needs of a user. Preferably, the monitor support stand 12 is connected to one of the rear support legs located proximate to the left and right, i.e. the laterally spaced edge regions of the keyboard supporting worksurface 21. Referring to FIG. 7, the connection is accomplished by first placing the inner bearing halves 32 within the respective upper and lower bearing seats 28 and 29 of the monitor support stand 12. The bearing seats 28 and 29 are fitted over the peripheral surface of the selected support leg 15 and then the outer bearing halves 34 are fitted over the outer periphery of the support leg on the opposite side thereof and in alignment with the inner bearing halves 32. The mounting or clamping brackets 36 are then placed over the outer bearing halves 34 and secured in place by four fasteners 41. Preferably the fasteners 41 are first tightened and then loosened by a partial turn of the fastener 41 so as to facilitate swinging movement of the monitor support stand 12 about the longitudinal axis of the support leg 15.

Either before or after placement of the monitor onto the monitor support tray 62, the height of the monitor support tray 62 may be adjusted by telescoping adjustment of the inner tubular member 56 of the support column 53 and then inserting the pin 59 into selected apertures 58. Additionally, the inner tubular member 56 is rotatable relative to the outer tubular member 54 so as to permit angular adjustment of the monitor support tray 62 without the necessity of swinging the monitor support stand 12 about the support leg 15. Should repositioning of the computer workstation 10 be necessary, the keyboard support stand 11 and the monitor support stand 12 can be moved in unison from one area to another.

With the computer workstation of this invention, there is provided a durable but compact monitor support stand which can be readily attached to or detached from a keyboard supporting table or stand, such as by being attached to one of the legs thereof, whereby increased user workspace and flexibility can be readily achieved by permitting the monitor to be supported on the separate stand 12 so as to not interfere with or occupy any of the space provided on the main worksurface. At the same time this monitor stand 12 possesses a high degree of flexibility and mobility in that it can be in its entirety swiveled about the leg to which it is connected, and the stand itself allows the monitor to be angularly displaced about the axis of the support column while additionally permitting vertical height adjustment. This thus enables the user to have a high degree of flexibility with respect to desirable positioning of the monitor relative to the remainder of the workstation. The monitor stand 12, as is apparent from the above description, is not, by itself, stable or self-supporting in an upright position, but rather becomes so only when the cross arm 24 thereof is attached to one of the legs or uprights associated with the main worksurface structure such as 11 or 11'. However, the monitor support stand 12, due to its wheel-supported base arrangement, does have a load bearing rolling engagement with the floor, whereby the loads imposed by the monitor and by the stand 12 itself are transmitted directly to the floor so that the attachment of the stand 12 to the main worksurface arrangement 11 or 11' is principally for purposes of stability.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A computer workstation for supporting a keyboard and a monitor of a computer, comprising:

a computer support stand which includes a horizontally enlarged worksurface for supporting a keyboard thereon, and a plurality of tubular support legs which extend upwardly from a floor and are interconnected to said worksurface for supporting said worksurface at a worksurface height, said support legs being generally vertically elongate so as to define an upwardly extending longitudinal axis; and a monitor support stand connected to said computer support stand, said monitor support stand including a base structure having a base movably positioned on the floor and a support column which extends upwardly from said base, a monitor support connected to said support column for supporting a monitor thereon, and a cross member which includes a first end rigidly connected to said base structure and a second end extending toward one of said support legs, said second end of said cross member including mounting means for pivotal engagement of said cross member to said one support leg so that said monitor support stand is horizontally swingable about the longitudinal axis of said one support leg, said support column comprising a first column member defining a hollow interior and a second column member telescopingly received within said hollow interior of said first member, a lower one of said first and second column members being connected to said base and an upper one of said first and second column members being connected to said monitor support such that said monitor support is vertically movable relative to said base.

2. A computer workstation according to claim 1, wherein said support column includes stop means for fixedly locking said first column member relative to said second column member to at least prevent downward vertical movement of said monitor support relative to said base.

3. A computer workstation according to claim 2, wherein said stop means comprises a plurality of apertures formed in said upper one of said first and second column members, said apertures being vertically spaced longitudinally along said upper one of said first and second column members, and a pin selectively inserted into one of said apertures so as to abut against an upper end of said lower one of said first and second column members and limit downward telescoping movement of said upper one of said first and second column members.

4. A computer workstation according to claim 1, wherein said second column member is rotatable within said hollow interior of said first column member so that said monitor support is rotatable relative to said base.

5. A computer workstation according to claim 4, wherein said monitor support defines a horizontally enlarged planar surface which faces upwardly for supporting a monitor thereon.

6. A computer workstation according to claim 1, wherein said base has at least one rolling element mounted thereon and disposed in supporting and rolling engagement with the floor.

7. A computer workstation for supporting a keyboard and a monitor of a computer, comprising:

a computer support stand which includes a horizontally enlarged worksurface for supporting a keyboard thereon, and a support frame which extends upwardly from a floor and is interconnected to said worksurface for supporting said worksurface at a worksurface height, said support frame including a frame element which is generally vertically elongate so as to define an upwardly extending longitudinal axis; and a monitor support stand connected to said computer support stand, said monitor support stand including a base structure having a base movably positioned on the floor and a support column which extends upwardly from said base, a monitor support connected to said support column for supporting a monitor thereon, and a cross member which includes a first end rigidly connected to said base structure and a second end extending toward said frame element, said second end of said cross member including mounting means for pivotal engagement of said cross member to said frame element so that said monitor support stand is horizontally swingable about the longitudinal axis of said one support leg, said base includes a pair of support legs which are fixed to and project generally horizontally outwardly from a lower end of said support column, said legs extending in generally transverse relation with respect to one another and projecting radially outwardly from said support column on a side thereof which is substantially opposite said cross member whereby an extension of a longitudinal centerline of said cross member through said support column substantially bisects the included angle defined between said pair of support legs, and a caster assembly mounted on each said support leg adjacent an outer end thereof and disposed in rolling and supportive engagement with the floor. mounted thereon and disposed in supportive and rolling engagement with the floor.

8. A computer workstation according to claim 1, wherein said mounting means comprises a bearing portion extending about the periphery of said one support leg, said mounting means being removable for pivotal engagement with another of said support legs.

9. A computer workstation for supporting a keyboard and a monitor of a computer, comprising:

a computer support stand having a horizontally enlarged worksurface for supporting a keyboard thereon, and a support frame connected to said worksurface for vertically supporting said worksurface, said frame including at least one upright frame member which defines an upwardly extending longitudinal axis; and a monitor support stand connected to said computer support stand, said monitor support stand including a base movably positioned on a floor, a support column which extends upwardly from said base and includes a monitor support connected thereto for supporting a monitor, and a cross member which includes a first end rigidly connected to said base and a second end extending toward said frame member, said second end of said cross member including mounting means for pivotal engagement of said cross member to said frame member so that said monitor support stand is swingable about said longitudinal axis, said support column comprising a lower column member and an upper column member movably connected to said lower column member so as to be vertically movable and rotatable about an upwardly extending axis relative to said lower column member, said lower column member being fixedly connected to said base and said upper column member being connected to said monitor support such that said monitor support is vertically movable and rotatable relative to said base.

10. A computer workstation according to claim 9, wherein said support column includes stop means for fixedly locking said upper column member relative to said lower column member to prevent downward vertical movement of said support column relative to said base.

11. A computer workstation according to claim 9, wherein said upper column member is rotatably and telescopingly engaged with said lower column member so that said monitor support is rotatable and vertically movable.

12. A computer workstation according to claim 9, wherein said monitor support defines a horizontally enlarged planar surface which faces upwardly for supporting a monitor thereon, said monitor support stand including mounting means for fixedly securing a monitor to said monitor support, said mounting means comprising a plurality of clips including a clamping portion for clamping a monitor onto said planar surface and engagement means for connecting said clips to said planar surface.

13. A computer workstation according to claim 9, wherein said frame includes a plurality of said frame members disposed at least in laterally spaced relation proximate a rearward edge region of said worksurface, said mounting means comprising a bearing portion connected to a periphery of one said frame member, said mounting means being removable for pivotal engagement with any one of said frame members.

14. A computer workstation according to claim 13, wherein each of said frame members comprise an upwardly extending cylindrical support leg having a substantially circular outer peripheral surface, said bearing portion defining a circular opening therethrough which receives one said support leg therein with said bearing portion being swingable about said support leg.

15. A computer workstation, comprising in combination:

a freestanding worksurface arrangement adaptable for supporting a keyboard thereon, said worksurface arrangement including an upright frame which is supportingly engaged on a floor, and a generally horizontally enlarged worksurface mounted on said frame in upwardly spaced relation from said floor, said worksurface defining thereon a generally planar and enlarged upwardly facing surface, said frame including a frame element which is positioned under said worksurface adjacent a peripheral edge thereof; and an upright support stand positioned at least partially in supportive engagement with the floor and positioned sidewardly adjacent and interconnected to said worksurface arrangement, said support stand including an upright base structure which is provided with at least one roller adjacent a lower end thereof, said roller being disposed in supportive and rolling engagement with the floor, said base structure including a vertically elongate upright column defining a generally vertically extending longitudinal axis, and a horizontally enlarged tray fixed to said column adjacent an upper end thereof, said column including upper and lower column members which are both vertically telescopedly supported one with the other and relatively rotatable with respect to one another about the longitudinal axis to enable the tray to be positionally adjusted both vertically and rotationally about said longitudinal axis, said tray defining thereon a generally planar and horizontally enlarged upper surface adapted to support a computer monitor thereon, clamping means engageable with said tray for clamping a computer monitor to the upper surface thereof, and a generally elongate and horizontally extending connecting arm having one end thereof fixed to said base structure and projecting horizontally outwardly away from said column and being provided with releasable connecting means adjacent an outer free end thereof for releasable attachment to the frame element on said worksurface arrangement, whereby said support stand can be positioned with the tray disposed sidewardly adjacent the worksurface and adjustably positioned relative thereto.

16. A workstation according to claim 15, wherein said frame element has a generally cylindrical outer profile defined about a generally vertical axis, and wherein said releasable connecting means defines a generally annular bearing which rotatably supportingly surrounds said frame element to enable said support stand to be horizontally pivotally displaced relative to said worksurface about the vertical axis of said frame element, and said support stand being stably supportable in an upright position only when said cross arm is attached to said frame element.

17. An upright support stand for supporting a computer monitor thereon, said support stand comprising:

a horizontally enlarged support tray defining thereon a generally enlarged and horizontally planar upper surface adapted to support thereon a computer monitor;

clamping means mountable on said tray and releasably engageable with a monitor for permitting the monitor to be fixedly but releasably attached to said support tray;

a base structure fixed to said support tray and projecting downwardly therefrom for supportive and load-bearing engagement with a floor, said base structure including a vertically elongate and vertically extendible support column defining a generally vertically extending central axis, said support column at an upper end thereof being fixedly secured to an underside of said support tray;

said base structure including a base member fixed to said column adjacent a lower end thereof, said base member mounting at least one rolling element thereon with said rolling element being disposed in supportive and rolling engagement with the floor so as to normally maintain said base member in upwardly spaced relation from the floor; and a horizontally elongate attaching arm fixedly attached to said base structure and projecting horizontally outwardly in a direction generally radially away from said column in a cantilevered fashion so as to terminate in a free end; and a connecting hinge structure defining a generally vertical hinge axis provided on the free end of said attaching arm for providing a releasable pivotal connection to a separate and independent upright structure.

18. A support stand according to claim 17, wherein said base member includes a pair of support arms which are fixed to and project radially outwardly in generally transverse relation relative to one another away from the lower end of said support column, and a said support roller being mounted on each said support leg adjacent a radially outer end thereof, said support legs projecting outwardly away from said support column on substantially the opposite diametral side thereof from said attaching arm.

19. A support stand according to claim 18, wherein said clamping means includes a plurality of clips which releasably attach between said support tray and the monitor, said support tray having a plurality of openings associated therewith for permitting said clips to be releasably attached to said tray at a plurality of different locations.

* * * * *

UNITED STATES PATENT AND TRADEMARK OFFICE

CERTIFICATE OF CORRECTION

PATENT NO. : 5 704 298

DATED : January 6, 1998

INVENTOR(S) : Roque Matias Corpuz, Jr. et al

It is certified that error appears in the above-indentified patent and that said Letters Patent is hereby corrected as shown below:

Column 7, line 64; change "supporting" to ---supportive---.

Column 8, line 35; delete "mounted thereon and disposed in".

line 36; delete "supportive and rolling engagement with the floor.".

Signed and Sealed this

Second Day of June, 1998

*Attest:*

*Attesting Officer*

BRUCE LEHMAN

*Commissioner of Patents and Trademarks*